US010890044B2

(12) United States Patent
Vincent

(10) Patent No.: US 10,890,044 B2
(45) Date of Patent: Jan. 12, 2021

(54) TUBULAR WELLHEAD ASSEMBLY

(71) Applicant: ONESUBSEA IP UK LIMITED, London (GB)

(72) Inventor: Jack Heath Vincent, Katy, TX (US)

(73) Assignee: ONESUBSEA IP UK LIMITED, London (GB)

( * ) Notice: Subject to any disclaimer, the term of this patent is extended or adjusted under 35 U.S.C. 154(b) by 265 days.

(21) Appl. No.: 15/337,982

(22) Filed: Oct. 28, 2016

(65) Prior Publication Data

US 2018/0119513 A1 May 3, 2018

(51) Int. Cl.

| | |
|---|---|
| ***E21B 33/038*** | (2006.01) |
| ***E21B 47/06*** | (2012.01) |
| ***E21B 47/12*** | (2012.01) |
| ***E21B 34/04*** | (2006.01) |
| ***E21B 33/035*** | (2006.01) |
| ***E21B 33/043*** | (2006.01) |
| *E21B 33/04* | (2006.01) |
| *E21B 33/03* | (2006.01) |

(52) U.S. Cl.

CPC ..... *E21B 33/038* (2013.01); *E21B 33/035* (2013.01); *E21B 33/0355* (2013.01); *E21B 33/043* (2013.01); *E21B 34/04* (2013.01); *E21B 47/06* (2013.01); *E21B 47/12* (2013.01); *E21B 33/03* (2013.01); *E21B 33/04* (2013.01)

(58) Field of Classification Search

CPC .... E21B 33/03; E21B 33/035; E21B 33/0355; E21B 33/038; E21B 33/04; E21B 33/043

See application file for complete search history.

(56) References Cited

U.S. PATENT DOCUMENTS

| | | | | |
|---|---|---|---|---|
| 3,142,337 | A * | 7/1964 | Poorman, Jr. | E21B 33/0355 166/338 |
| 6,736,213 | B2 * | 5/2004 | Bussear | E21B 34/10 166/319 |
| 8,733,436 | B2 * | 5/2014 | Donald | E21B 33/03 166/91.1 |
| 9,334,705 | B1 * | 5/2016 | Ward | E21B 33/038 |
| 2010/0230110 | A1 * | 9/2010 | Voss | E21B 33/035 166/339 |

(Continued)

OTHER PUBLICATIONS

"Wellhead", Schlumberger Oilfield Glossary. Published Mar. 13, 2016. Retrieved Jun. 25, 2020. (Year: 2016).*

*Primary Examiner* — Tara Schimpf
(74) *Attorney, Agent, or Firm* — Helene Raybaud

(57) ABSTRACT

A wellhead assembly of a well system for installation in a wellbore, the wellhead assembly having a longitudinal axis and including a wellhead housing including a central passage defined by an inner surface, a hanger configured to be received within the passage of the wellhead housing and couple to the inner surface of the housing, a tubular string configured to be received in the passage of the wellhead housing, wherein the tubular string includes a passage, a choke coupled to the tubular string and configured to control a fluid flow through the passage of the tubular string, and a wellhead connector configured to releasably couple to an end of the wellhead housing and including a first passage in fluid communication with passage of the tubular string when the wellhead connector is coupled to the wellhead housing.

22 Claims, 7 Drawing Sheets

(56) References Cited

U.S. PATENT DOCUMENTS

| | | | | |
|---|---|---|---|---|
| 2013/0018514 | A1* | 1/2013 | Addala | E21B 33/0355<br>700/282 |
| 2013/0098633 | A1* | 4/2013 | Fenton | E21B 43/0122<br>166/382 |
| 2015/0159458 | A1* | 6/2015 | Tan | E21B 33/0422<br>166/348 |
| 2018/0135375 | A1* | 5/2018 | Brown | E21B 34/04 |
| 2019/0368298 | A1* | 12/2019 | Witwer | E21B 33/0355 |

* cited by examiner

TUBULAR WELLHEAD ASSEMBLY

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

This section is intended to provide background information to facilitate a better understanding of the various aspects of the presently described embodiments. Accordingly, it should be understood that these statements are to be read in this light, and not as admissions of prior art.

Well systems may be configured to drill into a subterranean earthen formation to form a well or wellbore therein, allowing for the production of hydrocarbons from the formation. In some applications, the well system includes a wellhead disposed at or near the top of the wellbore for supporting components extending therein, such as an outer casing string used to physically support the wellbore, and control fluid flow between the subterranean formation and the wellbore. The wellhead may additionally support a tubing string disposed within the casing string for receiving hydrocarbons produced from the formation and/or for injecting fluids into the formation.

In some applications, a well system may include a tree coupled to the wellhead above the wellbore and generally configured to direct fluid flow between the wellbore and other components of the well system in fluid communication with the tree. For instance, the tree may include one or more master valves configured to control (i.e., selectively permit and restrict) fluid communication between a passage of the tubing string and production equipment in fluid communication with the tree. Additionally, the tree may also include a conduit providing selective fluid communication to an annulus formed between the casing and tubing strings in the wellbore. Further, in certain applications, the tree may include a choke or other device for controlling the rate of fluid flow from or into the wellbore, and one or more sensors or other electronic equipment for measuring parameters of the wellbore and fluid produced therefrom.

BRIEF DESCRIPTION OF THE DRAWINGS

Non-limiting embodiments of a tubular wellhead assembly are described in the following detailed description with reference to the following figures. The same numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

Figure 1:
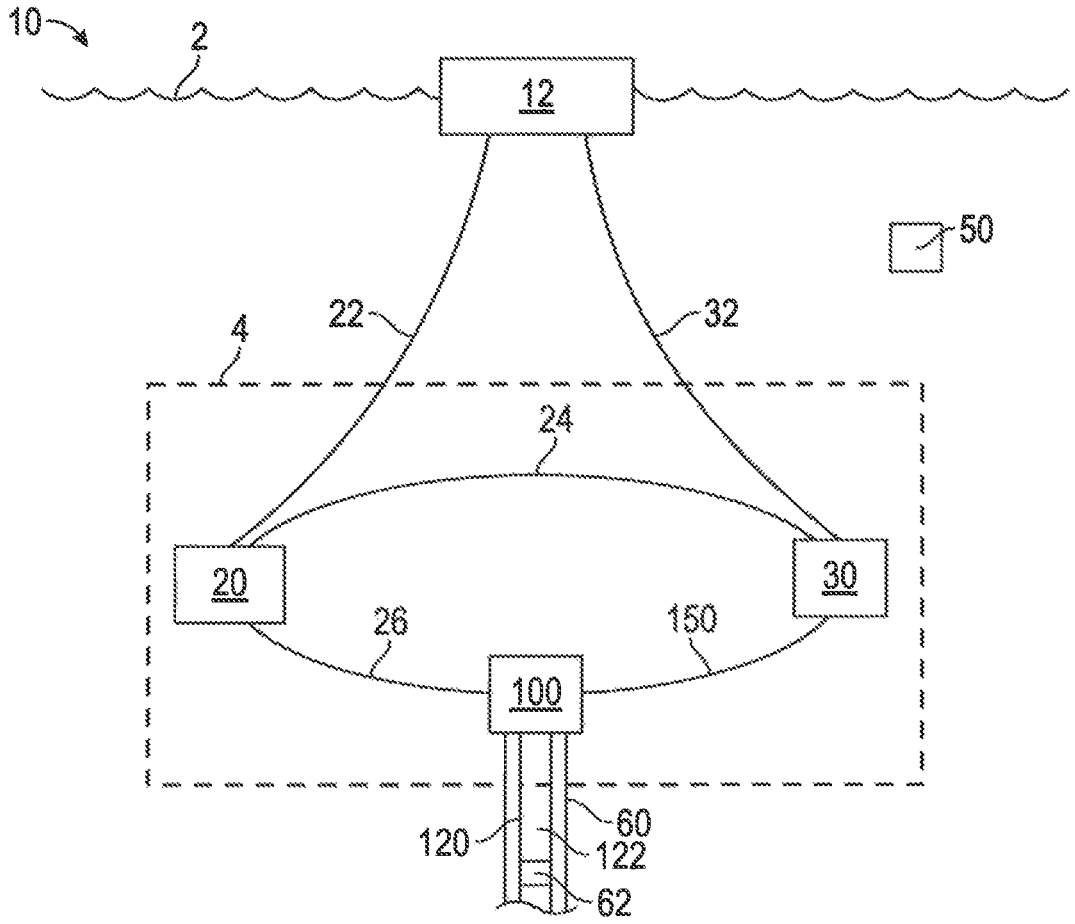
FIG. 1 is a schematic view of an offshore well system in accordance with one or more embodiments of the present disclosure.

The present disclosure is susceptible to embodiments of different forms. Specific embodiments are described in detail below and are shown in the drawings, with the understanding that the present disclosure is to be considered an exemplification of the principles of the disclosure, and is not intended to limit the disclosure to that illustrated and described herein. In an effort to provide a concise description of these specific embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure. It is to be fully recognized that the different teachings of the embodiments discussed below may be employed separately or in any suitable combination to produce desired results.

Unless otherwise specified, in the following discussion and in the claims, the articles "a," "an," and "the" are intended to mean that there are one or more of the elements. The terms "including," "comprising," "having," and variations thereof are used in an open-ended fashion, and thus should be interpreted to mean "including, but not limited to . . . " Any use of any form of the terms "connect," "engage," "couple," "attach," "mate," "mount," or any other term describing an interaction between elements is intended to mean either an indirect or a direct interaction between the elements described. In addition, as used herein, the terms "axial" and "axially" generally mean along or parallel to a central axis (e.g., central axis of a body or a port), while the terms "radial" and "radially" generally mean perpendicular to the central axis. The use of "top," "bottom," "above," "below," "upper," "lower," "up," "down," "vertical," "horizontal," and variations of these terms is made for convenience but does not require any particular orientation of the components.

Certain terms are used throughout the following description and claims to refer to particular features or components. As one skilled in the art will appreciate, different persons may refer to the same feature or component by different names. This document does not intend to distinguish between components or features that differ in name but not function. The various features and characteristics of the present disclosure will be readily apparent to those skilled in the art upon reading the following detailed description of embodiments with reference to the accompanying drawings.

Referring to FIG. 1, a schematic of a well system 10 is shown. In the embodiment shown in FIG. 1, well system 10 comprises an offshore well system including a hydrocarbon production and/or fluids injection system; however, in other embodiments, well system 10 may comprise a surface well system. The well system 10 generally includes a surface platform 12, an umbilical termination assembly (UTA) 20, a pipeline end manifold (PLEM) or pipeline end termination (PLET) 30, and a wellhead assembly, which in FIG. 1 is shown to be a tubular wellhead assembly 100 of the present disclosure. During certain intervention or other operations, a remotely operated underwater vehicle (ROV) 50 may be used. Surface platform 12 is disposed at or near the sea surface or waterline 2. In FIG. 1 surface platform 12 is depicted as a semi-submersible production platform; however, surface platform 12 may also be any of a variety of other surface vessels or platforms known in the art. In the schematic of FIG. 1, tubular wellhead assembly 100, UTA 20, and PLET 30 are disposed at or near the sea floor or mudline 4, vertically spaced from distal surface platform 12.

In the embodiment shown in FIG. 1, pressurized fluids, electrical power, and/or communications are provided to the components of well system 10 disposed at or near the sea floor 4 via an umbilical 22 that extends between surface platform 12 and UTA 20. UTA 20 is configured to route selected fluids, power, and/or communications provided by umbilical 22 to the appropriate components of well system 10 disposed at or near the sea floor 4. In the embodiment shown in FIG. 1, UTA 20 is connected to PLET 30 via a first jumper or flying lead 24 while UTA 20 connects to the tubular wellhead assembly 100 via a second jumper or flying lead 26. Jumpers 24 and 26 may each provide fluid, power, and/or communications connections between UTA 20 and PLET 30 and the tubular wellhead assembly 100, respectively.

In embodiments, and as shown in FIG. 1, an upper end of the tubular wellhead assembly 100 is disposed above a hydrocarbon producing well or wellbore 60 extending into a subterranean earthen formation below the sea floor or mudline 4, and is configured to provide hydrocarbons from wellbore 60 to PLET 30 via a wellhead fluid flowline or jumper 150 of the tubular wellhead assembly 100 extending therebetween. As shown schematically in FIG. 1, tubular wellhead assembly 100 includes a tubular or tubing string 120 that extends at least partially through the wellbore 60, where tubing string 120 includes a central bore or production passage 122 extending axially therein. In some embodiments, wellbore 60 comprises a cased wellbore lined by a casing string; however, in other embodiments, wellbore 60 comprises an uncased wellbore. In the embodiments shown in FIG. 1, tubing string 120 may include a surface-controlled subsurface safety valve (SCSSV) 62 disposed within production passage 122. SCSSV 62 is configured to provide fail-safe functionality such that, in the event that control over tubular wellhead assembly 100 is lost, SCSSV 62 may be actuated to move from an open position permitting fluid flow through the production passage 122 of string 120, to a closed position restricting fluid flow in the direction of the upper end of tubular wellhead assembly 100 (i.e., out of the wellbore 60). However, when in the closed position, SCSSV 62 is not configured to restrict fluid flow downward through production passage 122 toward a lower end of wellbore 60. Further, the closed position of the SCSSV 62 does not necessarily provide a gas-tight seal. In some embodiments, SCSSV 62 may comprise a flapper valve actively held in the open position via hydraulic control pressure such that loss of the control pressure results in the shutting of the SCSSV 62.

Still referring to FIG. 1, PLET 30 is configured to supply surface platform 12 with extracted hydrocarbons via a production flowline 32 extending therebetween. Production flowline 32 is shown schematically in FIG. 1 as comprising part of a pipeline and riser system extending vertically between the sea surface or waterline 2 and the sea floor or mudline 4. Although tubular wellhead assembly 100 is shown in FIG. 1 as connecting with PLET 30 via wellhead flowline 150, in other embodiments, tubular wellhead assembly 100 may be connected with various components, including directly with the surface platform 12 or to a subsea manifold. Additionally, although tubular wellhead assembly 100 is shown as comprising an offshore hydrocarbon production system, in other embodiments, tubular wellhead assembly 100 may be used in offshore drilling or well intervention systems. In still further embodiments, tubular wellhead assembly 100 may be used in surface or onshore well systems.

As described above, tubular wellhead assembly 100 provides access to the subterranean wellbore 60 extending from wellhead assembly 100, allowing for the production of hydrocarbons from the subterranean earthen formation or injection into the formation through which wellbore 60 extends. As will be discussed further herein, tubular wellhead assembly 100 is also configured to include components and functionalities typically provided by a production tree (or injection tree) coupled to the wellhead of a well system, including for example valves for isolating wellbore 60, chokes, or other mechanisms for controlling fluid flow from wellbore 60, and passages for providing communication of electric and/or hydraulic control signals/fluids for controlling components of wellhead assembly 100 and monitoring conditions within tubular wellhead assembly 100 and its corresponding wellbore 60. Thus, as will be detailed below, tubular wellhead assembly 100 is configured to combine the functionalities provided by a typical wellhead and tree within a single tubular wellhead assembly 100. By incorporating the components and functionalities of a typical tree (e.g., a production tree) within tubular wellhead assembly 100, required hardware can be reduced, operations of well system 10 may be simplified, and additional capabilities may be provided such as the pigging of tubular wellhead assembly 100 and associated components.

Figure 2:
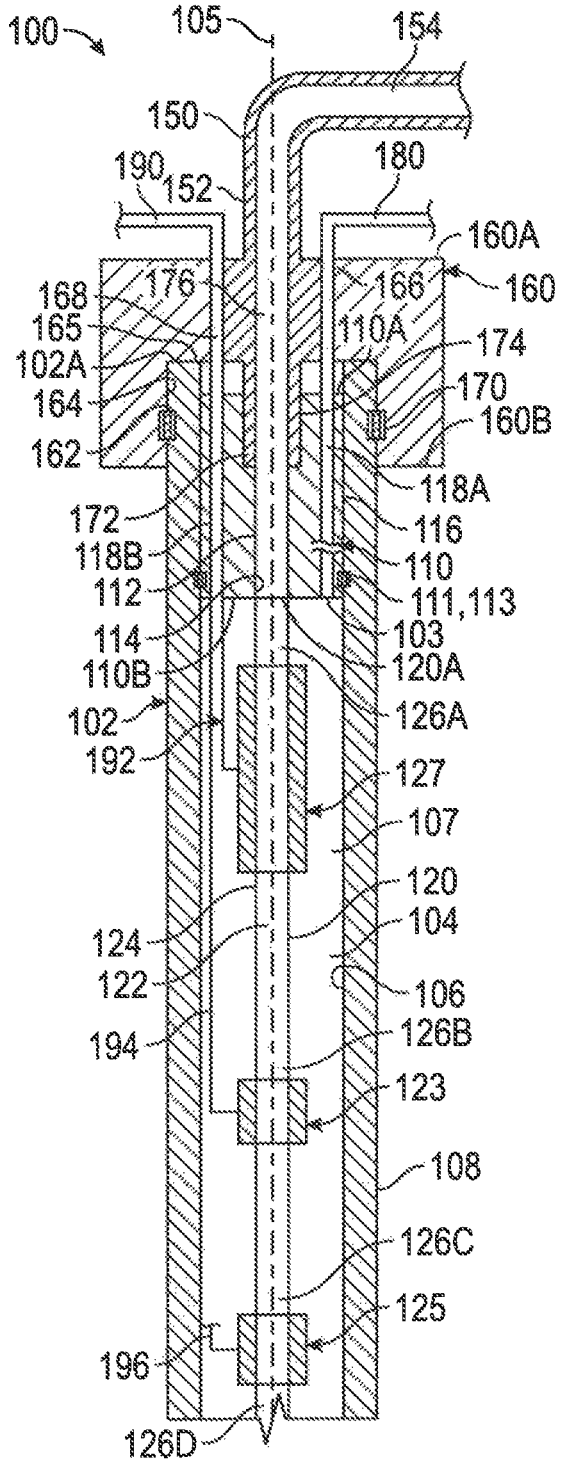
FIG. 2 depicts a wellhead assembly of the well system of FIG. 1 in accordance with one or more embodiments of the present disclosure.

Referring to FIG. 2, embodiments of a tubular wellhead assembly 100 of the present disclosure are shown. In the illustrated embodiments, tubular wellhead assembly 100 has a central or longitudinal axis 105 and generally includes a wellhead or outer housing 102, a hanger or tubing hanger 110, tubing string 120, wellhead jumper 150, and a wellhead connector 160. Wellhead housing 102 is generally cylindrical and extends from an upper end of wellbore 60 extending into sea floor 4 (shown in FIG. 1). Wellhead housing 102 generally includes a first or upper end 102A, a central bore or passage 104 defined by a generally cylindrical inner surface 106, and a generally cylindrical outer surface 108. In the embodiments shown in FIG. 2, wellhead housing 102 comprises a high-pressure housing that may be physically supported by a low-pressure or conductor housing (not shown) disposed about wellhead housing 102, where the low-pressure housing may couple with a conductor casing (not shown) that physically supports the upper end of wellbore 60 of tubular wellhead assembly 100. In this arrangement, a lower end of the wellhead housing 102 is coupled with a casing string (not shown) that extends into wellbore 60 for physically supporting wellbore 60 and/or selectively controlling fluid communication between wellbore 60 and the surrounding subterranean formation. However, in other embodiments, wellhead housing 102 may comprise wellhead or wellhead-associated components of tubular wellhead assembly 100 other than the high-pressure housing.

Tubing hanger 110, which is shown schematically in FIG. 2, is generally cylindrical and disposed within the passage 104 of wellhead housing 102 and is physically supported by housing 102. Tubing hanger 110 generally includes a first or upper end 110A, a second or lower end 110B, a central bore 112 extending between ends 110A and 110B and defined by a generally cylindrical inner surface 114, and a generally cylindrical outer surface 116 also extending between ends 110A and 110B. In the embodiments shown in FIG. 2, the outer surface 116 of tubing hanger 110 is configured to physically engage or seat against the inner surface 106 of housing 102 at a landing interface 103. In some embodiments, landing interface 103 comprises the interface formed between opposing annular shoulders formed on the outer surface 116 of tubing hanger 110 and the inner surface 106 of housing 102; however, in other embodiments, tubing hanger 110 may be landed within housing 102 using other mechanisms known in the art. Tubing hanger 110 is axially locked (i.e., relative axial movement is restricted) into position within the passage 104 of housing 102 via a hanger locking member 111 disposed radially between housing 102 and tubing hanger 110.

In the embodiments shown in FIG. 2, hanger locking member 111 comprises a hanger lock ring 113 hydraulically actuatable between an unlocked position permitting relative axial movement between tubing hanger 110 and housing 102 and a locked position restricting relative axial movement therebetween. In other embodiments, hanger lock ring 113 may be actuatable between the locked and unlocked positions via mechanical or electronic actuators. In still other embodiments, hanger locking member 111 may comprise other locking mechanisms known in the art configured for releasably coupling together concentrically disposed tubular members. In the embodiments shown in FIG. 2, tubing hanger 110 additionally includes a plurality of annulus or offset bores 118A and 118B extending axially therethrough but radially offset from central axis 105. Particularly, the tubing hanger 110 shown in FIG. 2 includes an annulus passage 118A and a control line passage 118B each radially offset from central axis 105; however, in other embodiments, tubing hanger 110 may include varying numbers of offset bores, including zero offset bores. Although in the embodiments shown in FIG. 2 hanger 110 comprises a tubing hanger, in other embodiments, hanger 110 may comprise other types of hangers known in the art that are supported within wellhead housings, such as casing hangers and the like.

Tubing string 120 extends axially through passage 104 of housing 102 and is physically supported by tubing hanger 110 at a first or upper end 120A of tubing string 120 that is coupled to hanger 110 at or near lower end 110B. Tubular string 120 is configured to be received in the passage 104 of wellhead housing 102. In this manner, tubing string 120 is suspended from tubing hanger 110. Tubing string 120 includes production passage 122 and a generally cylindrical outer surface 124. Additionally, tubing string 120 is disposed substantially coaxial with central axis 105 of tubular wellhead assembly 100. An annulus 107 is formed within passage 104 of housing 102 that extends between the outer surface 124 of tubing string 120 and the inner surface 106 of housing 102. In the embodiments shown in FIG. 2, tubing string 120 comprises a plurality of tubular pipe joints 126 (shown as 126A-126D in FIG. 2) coupled together at threaded connections disposed therebetween; however, in other embodiments, tubular string 120 may comprise a single tubular body extending into wellbore 60 of tubular wellhead assembly 100 or other connection types.

As shown in FIG. 2, tubing string 120 may include production tubing configured to provide a fluid passage or flowpath for hydrocarbons or well fluids received from the formation surrounding wellbore 60. In this configuration, well fluids travel upward through the production passage 122 of tubing string 120 and into wellhead jumper 150, where they may then flow into PLET 30 and surface platform 12. However, in other embodiments, tubing string 120 may comprise another form of tubular string other than a production string, such as workover string or another tubular member configured to provide for fluid transport into and/or out of a wellbore.

In the embodiments shown in FIG. 2, tubing string 120 additionally includes a first or upper valve or selective barrier element 123 disposed proximal hanger 110, a second or lower valve or selective barrier element 125, and a choke or fluid control device 127. Valves 123, 125, and choke 127 are each generally tubular in shape and extend along central axis 105 of tubular wellhead assembly 100. Valves 123, 125, and choke 127 are releasably coupled with the tubular joints 126 of tubing string 120. In the embodiments shown in FIG. 2, choke 127 is threadably coupled between tubular joints 126A and 126B, upper valve 123 is threadably coupled between joints 126B and 126C, and lower valve 125 is threadably coupled between joints 126C and 126D; however, in other embodiments, valves 123, 125, and choke 127 may be coupled to tubing string 120 in other ways known in the art. Additionally, in other embodiments, tubular wellhead assembly 100 may only include a single valve 123 or 125 in conjunction with choke 127, where choke 127 provides the second seal of the dual barrier seal of tubular wellhead assembly 100.

Both upper valve 123 and lower valve 125 are configured to provide for independent selective isolation of the production passage 122 extending through tubing string 120 to restrict fluid flow through passage 122 via independently actuating valves 123 and 125 between open and closed positions. In this manner, valves 123 and 125 may each be actuated into the closed position to provide a dual seal barrier in production passage 122 of tubing string 120. Further, valves 123 and 125 are each configured to seal fluid flow in production passage 122 in both a first or upward direction (i.e., flowing toward bore 112 of tubing hanger 110) and in a second or downward direction opposite the first direction (i.e., flowing away from bore 112 of tubing hanger 110) when they are actuated into the closed position. Moreover, valves 123 and 125 each may provide a gas tight seal in passage 122 when they are actuated into the closed position. In the embodiment shown in FIG. 2, valves 123 and 125 each comprise ball valves; however, in other embodiments, valves 123 and 125 may comprise rotary gate valves, flapper valves, or other tubular valves known in the art. In some embodiments, valves 123 and 125 may be disposed above the sea floor 4, while in other embodiments, each valve 123 and 125 may be disposed beneath the sea floor 4.

The tubular choke 127 of tubular wellhead assembly 100 is generally configured to change or control the rate of flow of fluid flowing along production passage 122 toward the upper end 120A of tubing string 120. Particularly, choke 127 is actuatable between a fully open position providing for at least substantially full bore fluid communication therethrough and one or more partially closed positions that provide an obstruction in production passage 122, reducing the rate of fluid flow therethrough. In the embodiment shown in FIG. 2, choke 127 is mounted axially between upper valve 123 and the upper end 120A of tubing string 120; however, in other embodiments, choke 127 may be mounted in various locations along the axial length of tubing string 120. In still other embodiments, tubing string 120 may not include choke 127, and thus, many only include valves 123 and 125. In some embodiments, choke 127 comprises an inline choke, similar to the inline choke described in U.S. Pat. No. 8,109,330; however, in other embodiments, choke 127 may comprise other tubular fluid control devices known in the art.

In some embodiments, the tubular lower valve 125 provides the functionality associated with the master valve of a traditional separate tree, while the tubular upper valve 123 provides the functionality associated with the wing valve of the traditional separate tree (e.g., a production tree, an injection tree, a vertical tree, a horizontal tree, or a hybrid, flexible, or modular tree). In this manner, the components providing the functionality of the traditional master and wing valves are located within the passage 104 of wellhead housing 102 as part of tubing string 120, instead of being mounted to the upper end 102A of housing 102 as part of a traditional separate tree. Additionally, in some embodiments, the tubular choke 127 provides the functionality of the choke of a traditional separate tree. Thus, in the embodiments shown in FIG. 2, the component providing the functionality of the choke of a traditional separate production tree may be disposed in passage 104 of housing 102 as part of tubing string 120 instead of being mounted to the upper end 102A of housing 102 as part of a traditional separate production tree. In this arrangement, housing 102 may be connected directly with wellhead jumper 150, obviating the need for a traditional production tree mounted between the jumper and the wellhead and thereby facilitating a reduction in the overall time and expense incurred during the installation of tubular wellhead assembly 100 relative to a traditional wellhead assembly.

Additionally, instead of being mounted orthogonal to the central axis of the wellhead as part of a traditional production tree, valves 123, 125, and choke 127 of tubular wellhead assembly 100 are each disposed coaxial with central axis 105 of tubular wellhead assembly 100, providing a substantially linear production passage 122 extending through components 123, 125, and 127 that does not include any 90° bends, as would be the case in a traditional wellhead assembly. The linear arrangement of valves 123, 125, and choke 127 allows for the pigging (i.e., the displacement of a cylindrical obturating member or pig) along production passage 122 and through components 123, 125, and 127 for removing blockages formed therein or performing tests/collecting data within tubular wellhead assembly 100. In contrast, in a traditional wellhead assembly including a traditional production tree, pigging of the wellhead assembly may be limited or restricted by 90° bends in the traditional production tree.

Wellhead connector 160 is configured to provide a releasable connection between tubular wellhead assembly 100 and the other fluid components of the well system of which tubular wellhead assembly 100 forms a part, such as PLET 30 of well system 10 shown in FIG. 1. Additionally, in the embodiments shown in FIG. 2, wellhead connector 160 is configured to provide for fluid communication between both the production passage 122 of tubing string 120 and the annulus 107 with other fluid components of the well system of which tubular wellhead assembly 100 forms a part, such as components of well system 10. In the embodiment shown in FIG. 2, wellhead connector 160 is generally cylindrical and includes a first or upper end 160A, a second or lower end 160B, and a receptacle 162 extending into connector 160 from lower end 160B, where receptacle 162 is defined by an inner surface 164. Wellhead connector 160 is configured to releasably couple with wellhead housing 102. Wellhead connector 160 and receptacle 162 are each disposed substantially coaxial with central axis 105 of tubular wellhead assembly 100 when connector 160 is coupled with wellhead housing 102, as shown in FIG. 2. Additionally, wellhead connector 160 includes an annulus passage 166 and a communications passage 168, each radially offset from central axis 105 and extending between upper end 160A and an inner terminal end 165 of receptacle 162. In some embodiments, the upper end 110A of tubing hanger 110 is axially spaced from the inner terminal end 165 of receptacle 162; however, in other embodiments, upper end 110A may be disposed directly adjacent or physically engage terminal end 165.

The upper end 102A of wellhead housing 102 is received within receptacle 162 of wellhead connector 160. With housing 102 received within receptacle 162 of wellhead connector 160, connector 160 may be coupled or locked to housing 102 via an actuatable wellhead locking member 170 disposed radially between the outer surface 108 of housing 102 and the inner surface 164 of connector 160. In the embodiments shown in FIG. 2, wellhead locking member 170 comprises a lock ring 170 hydraulically actuatable between an unlocked position permitting relative axial movement and detachment between tubing wellhead connector 160 and wellhead housing 102, and a locked position restricting relative axial movement and locking connector 160 to housing 102. In other embodiments, lock ring 170 may be actuatable between the locked and unlocked positions via mechanical or electric actuators. In still other embodiments, wellhead locking member 170 may comprise other locking mechanisms known in the art configured for releasably coupling together concentrically disposed tubular members.

In the embodiments shown in FIG. 2, wellhead connector 160 additionally includes a generally cylindrical inner or hanger connector 172 that extends axially between the upper end 160A and lower end 160B of connector 160. In this arrangement, receptacle 162 forms an annulus extending radially between an outer generally cylindrical surface 174 of hanger connector 172 and the inner surface 164 of receptacle 162, where hanger connector 172 is disposed substantially coaxial with central axis 105 of tubular wellhead assembly 100 when connector 160 is coupled with wellhead housing 102. Hanger connector 172 of wellhead connector 160 is configured to be at least partially received within the bore 112 of tubing hanger 110. In this arrangement, fluid communication is provided between the production passage 122 of tubing string 120 and a central bore or connector passage 176 of inner connector 172 that extends axially through wellhead connector 160, where connector passage 176 is disposed substantially coaxial with central axis 105. Connector passage 176 is configured to be in fluid communication with a jumper passage or bore 154 extending through wellhead jumper 150. Wellhead jumper 150 of the well system 10 shown in FIG. 1 includes a terminal end 152 that couples to the upper end 160A of wellhead connector 160. In the embodiments shown in FIG. 2, wellhead jumper 150 is formed integrally or monolithically with wellhead connector 160 such that jumper 150 and connector 160 comprise a single component; however, in other embodiments, wellhead connector 160 may be releasably coupled to wellhead jumper 150 at terminal end 152.

In the embodiments shown in FIG. 2, tubular wellhead assembly 100 additionally includes an annulus fluid flowline or conduit 180 and a communications link 190. Annulus flowline 180 extends through annulus passage 166 of wellhead connector 160 and annulus passage 118A of tubing hanger 110 into annulus 107 to provide fluid communication between annulus 107 and annulus flowline 180, and from annulus flowline 180 to other components of the well system of which tubular wellhead assembly 100 forms a part, such as other components of the well system 10 shown in FIG. 1. Although not shown in FIG. 2, in some embodiments, annulus flowline 180 may include one or more valves for selectively restricting fluid flow between annulus 107 and flowline 180, and a choke for changing or controlling the rate of fluid flow between annulus 107 and flowline 180. In some embodiments, annulus flowline 180 may be used to inject fluids into annulus 107 and wellbore 60 disposed beneath wellhead housing 102. In some embodiments, annulus flowline 180 may be used to sample fluids from wellbore 60 via the fluid communication provided between annulus 107 and annulus flowline 180.

Communications link 190 of tubular wellhead assembly 100 is generally configured to send and receive signals (i.e., provide signal communication) between components of tubular wellhead assembly 100 and other components of the well system of which tubular wellhead assembly 100 forms a part, such as well system 10 shown in FIG. 1. Particularly, communications link 190 may be used to provide control signals to components of tubular wellhead assembly 100 and receive sensor signals from sensors disposed within tubular wellhead assembly 100. In the embodiments shown in FIG. 2, communications link 190 comprises a hydraulic control line conduit or jumper 190 that extends through communications passage 168 of wellhead connector 160 and control line passage 118B of tubing hanger 110 to connect with components of tubular wellhead assembly 100 disposed within the passage 104 of wellhead housing 102. Particularly, in the embodiments shown in FIG. 2, control line jumper 190 comprises a hydraulic choke control line 192, a hydraulic upper valve control line 194, and a hydraulic lower valve control line 196.

The individual control lines 192, 194, and 196 packaged in control line jumper 190 are configured to actuate the individual components to which they are connected. Thus, choke control line 192 is configured to selectively input a hydraulic control signal to choke 127 to actuate choke 127 between its fully open and partially closed positions to control or change the rate of fluid flow through production passage 122 of tubing string 120; upper control line 194 is configured to selectively input a hydraulic control signal to upper valve 123 to actuate valve 123 between its open and closed positions; and lower control line 196 is configured to selectively input, transmit, or communicate a hydraulic control signal to lower valve 125 to actuate valve 125 between its open and closed positions. Control line jumper 190 may be coupled with another component of well system 10 for controlling the transmission of hydraulic control signals to components 123, 125, and 127 via control lines 192, 194, and 196, respectively. In this manner, components 123, 125, and 127 each comprise remotely actuatable components that do not require the engagement by a mechanical tool, such as a tool conveyed on a coiled tubing string or a running tool, for actuating components 123, 125, and 127 between their respective positions. In some embodiments, control line jumper 190 is coupled with PLET 30 of well system 10 for receiving the hydraulic control signals; however, in other embodiments, control line jumper 190 may be coupled with a subsea control module (SCM) for controlling the input of hydraulic control signals to control lines 192, 194, and 196. In still other embodiments, a terminal end of control line jumper 190 may include a subsea connector, such as a plate connector, for interfacing with a ROV, such as the ROV 50 of well system 10, where the ROV may selectively provide the hydraulic pressure required for transmitting the hydraulic control signals to components 123, 125, and 127.

Although components 123, 125, and 127 are shown in FIG. 2 as comprising hydraulically actuatable components, in other embodiments, components 123, 125, and 127 may be electrically actuated between their corresponding positions. In certain embodiments, the communications link 190 comprises a wireless communications link configured for wirelessly transmitting control signals to components 123, 125, and 127. In this embodiment, each component 123, 125, and 127 would include an electric actuator configured to receive the wireless control signals from communications link 190 and actuate the corresponding component 123, 125, and 127 accordingly. In this embodiment, communications link 190 may be configured for wireless communication with other components of well system 10, including surface platform 12 and/or components located thereon, or communications link 190 may be hardwired via a jumper or other conduit to another component of well system 10.

Figure 3:
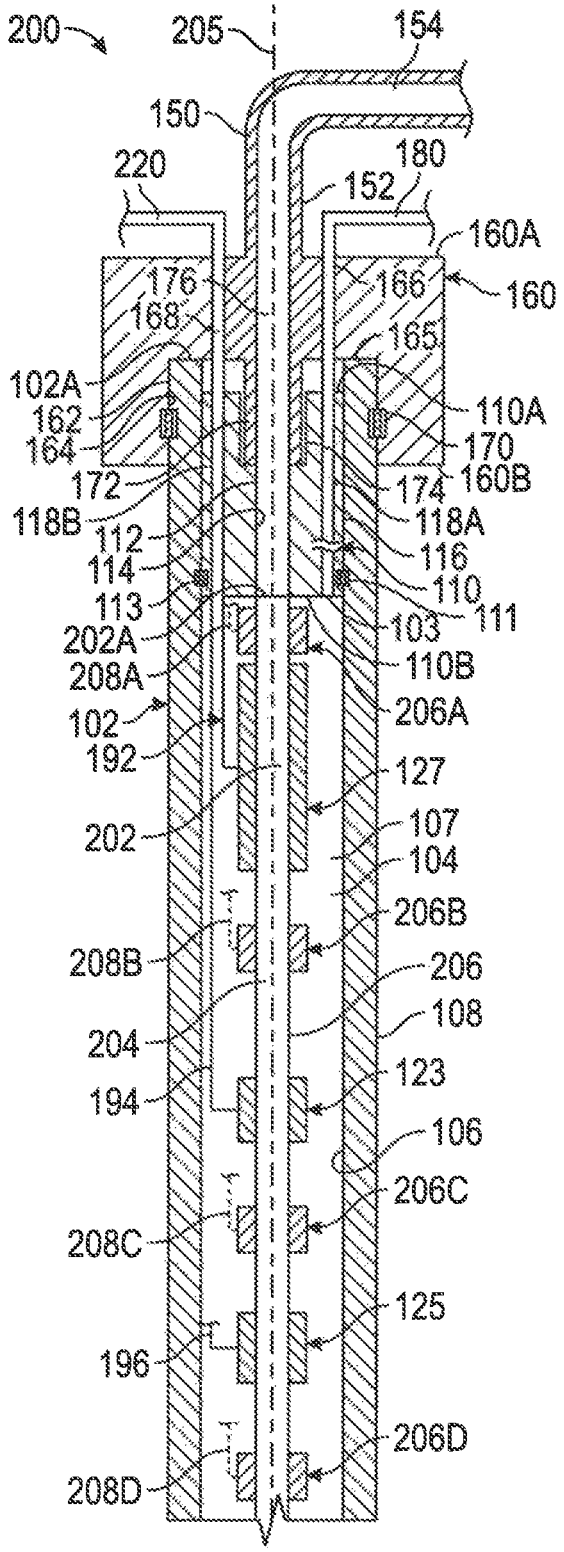
FIG. 3 depicts a wellhead assembly of the well system of FIG. 1 in accordance with one or more embodiments of the present disclosure.

Referring to FIG. 3, another embodiment of a tubular wellhead assembly 200 of the present disclosure is shown schematically. Tubular wellhead assembly 200 includes features in common with the tubular wellhead assembly 100 shown in FIG. 1, and shared features are labeled similarly. Tubular wellhead assembly 200 may be incorporated within well system 10 shown in FIG. 1, as well as in other well systems. In the embodiment shown in FIG. 3, tubular wellhead assembly 200 has a central or longitudinal axis 205 and includes a tubing string 202 and a communications link or control line conduit or jumper 220 in addition to wellhead housing 102, tubing hanger 110, and wellhead connector 160. Tubing string 202 extends axially through passage 104 of housing 102 and is physically supported by tubing hanger 110 at a first or upper end 202A of tubing string 202 which is coupled to tubing hanger 110. Tubing string 202 includes a central bore or production passage 204 extending axially therein and a generally cylindrical outer surface 206. Additionally, tubing string 202 is disposed substantially coaxial with central axis 205 of tubular wellhead assembly 200. Tubing string 202 comprises a plurality of threaded pipe joints and includes choke 127, upper valve 123, and lower valve 125.

In the embodiment shown in FIG. 3, tubing string 202 additionally includes a plurality of axially spaced tubing sensor packages or sensors 206 (shown as 206A-206D in FIG. 3). Sensors 206A-206D are coupled between the pipe joints forming tubular string 202 and are configured to sense or measure one or more parameters of fluid disposed within the production passage 204 at different axial locations along tubing string 202. Particularly, a first or upper sensor 206A is positioned axially between the lower end 110B of hanger 110 and choke 127, a second sensor 206B is positioned axially between choke 127 and upper valve 123, a third sensor 206C is positioned axially between upper valve 123 and lower valve 125, and a fourth or lower sensor 206D is positioned axially below lower valve 125. In this arrangement, at least one sensor 206 is positioned between each barrier element (e.g., valves 123, 125, and choke 127) of the embodiment of tubular wellhead assembly 200 shown in FIG. 3. Thus, sensors 206A-206D may be used to measure parameters of fluid disposed between each barrier element. In the embodiment shown in FIG. 3, each of sensors 206A-206D are configured to measure pressure and temperature within production passage 204. However, in other embodiments, sensors 206A-D may be configured to sense or measure a variety of parameters and conditions within production passage 204 such as sand content, erosion, composition, and salinity, for example.

In the arrangement described above, operators of tubular wellhead assembly 200 may monitor fluid conditions (e.g., pressure, temperature, etc.) adjacent a barrier element prior to and/or after actuating the barrier element between open and closed positions. For instance, upper sensor 206A and second sensor 206B may be used to monitor a pressure differential in a fluid flow passing through choke 127. In another example, second sensor 206B may be used to determine whether upper valve 123 has successfully actuated into the closed position sealing production passage 204. In a further example, upper sensor 206A may be used to monitor the temperature of fluid flowing out of choke 127 to ensure that the fluid temperature is not within a range susceptible to the formation of hydrates within the flowing fluid. In some embodiments, sensors 206A-206D may also be configured to sense or measure one or more parameters of fluid disposed within the annulus 107 (as well as wellbore 60 disposed beneath wellhead housing 102) formed between tubing string 202 and the inner surface 106 of wellhead housing 102 at the same axial locations as the fluid within production passage 204 is measured. In this manner, one or more of sensors 206A-206D may be used to measure conditions within both production passage 204 and annulus 107 at the same axial locations.

In the embodiment shown in FIG. 3, control line conduit 220, which extends into annulus 107 via communications passage 168 of wellhead connector 160 and control line passage 118B of tubing hanger 110, comprises individual control lines 192, 194, and 196 for controlling the actuation of choke 127, upper valve 123, and lower valve 125, respectively. Additionally, control line conduit 220 includes a plurality of production signal pathways 208 (shown as 208A-208D in FIG. 3) each in signal communication with a corresponding production sensor 206A-206D. Particularly, signal pathway 208A is in signal communication with upper sensor 206A, signal pathway 208B is in signal communication with second sensor 206B, signal pathway 208C is in signal communication with third sensor 206C, and signal pathway 208D is in signal communication with lower sensor 206D. In the embodiment shown in FIG. 3, signal pathways 208A-208D each comprise electrical cables providing a hardwired connection to sensors 206A-206D and transmit sensor data from sensors 206A-206D in real-time; however, in other embodiments, signal pathways 208A-208D may comprise wireless signal pathways 208D-208D with control line conduit 220 including a wireless communications link for communicating wirelessly with corresponding wireless communications links of sensors 206A-206D.

Figure 4:
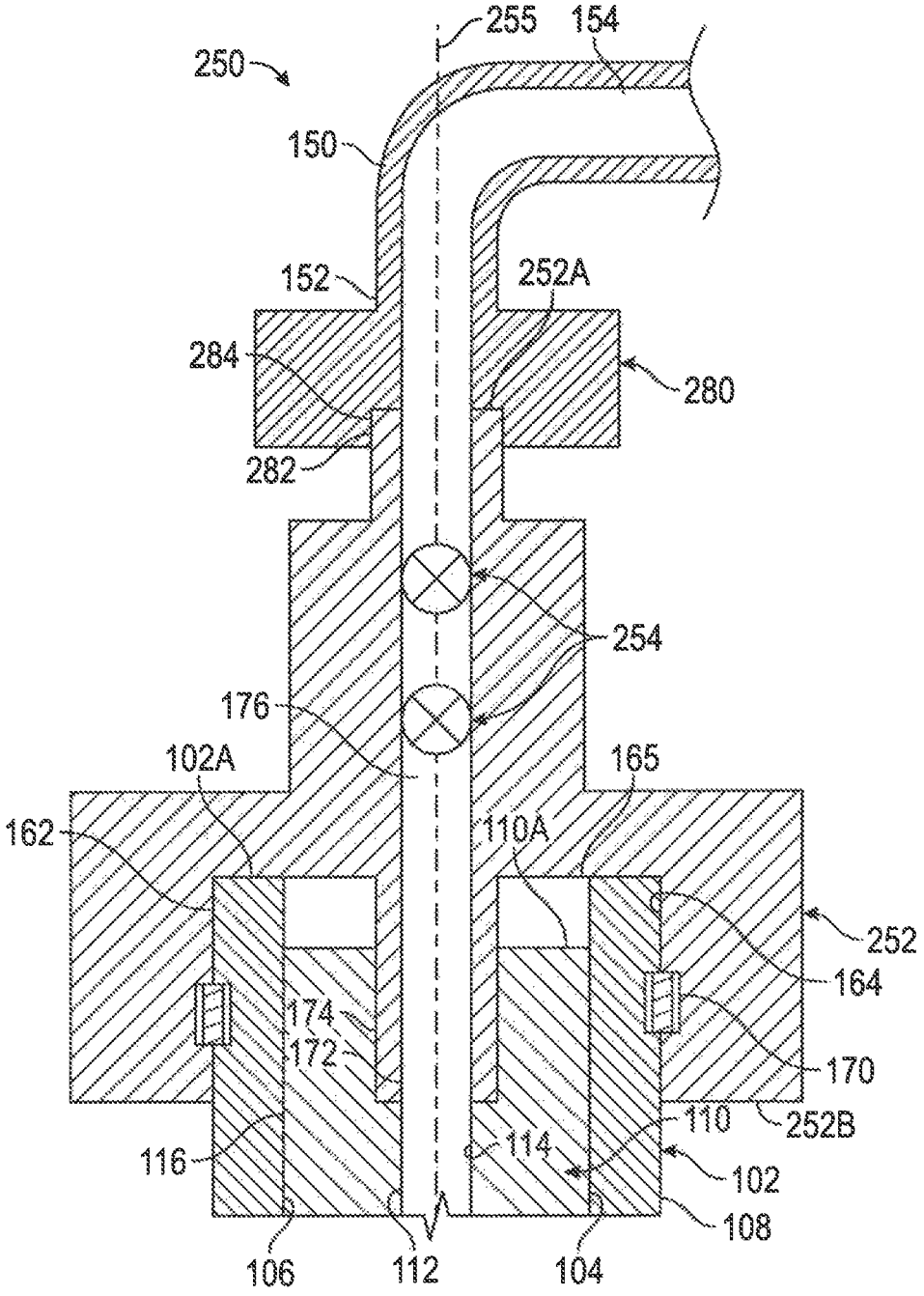
FIG. 4 depicts a wellhead assembly of the well system of FIG. 1 in accordance with one or more embodiments of the present disclosure.

Referring to FIG. 4, another embodiment of a tubular wellhead assembly 250 is shown schematically. Tubular wellhead assembly 250 includes features in common with the tubular wellhead assembly 100 shown in FIG. 1, and shared features are labeled similarly. Tubular wellhead assembly 250 may be incorporated within well system 10 shown in FIG. 1, as well as in other well systems. In the embodiment shown in FIG. 4, tubular wellhead assembly 250 has a central or longitudinal axis 255 and generally includes wellhead housing 102, tubing hanger 110, a wellhead connector 252, and a jumper adapter 280. Wellhead connector 252 includes a first or upper end 252A, a second or lower end 252B, and a pair of axially spaced connector valves or selective barrier elements 254 disposed in connector passage 176 for selectively restricting fluid flow through connector passage 176. Connector valves 254 provide a selective dual seal barrier for production fluid flowing through tubing string 120 in addition to valves 123 and 125. Additionally, in other embodiments, wellhead connector 252 may include only a single connector valve 254 or more than two valves 254. In the embodiment shown in FIG. 4, connector valves 254 comprise valves similar in configuration to valves used in traditional production trees; however, in other embodiments, connector valves 254 may be configured similarly as valves 123 and 125, and thus, may comprise rotary gate valves, flapper valves, or other tubular valves known in the art. As with valves 123 and 125, connector valves 254 may be actuated hydraulically (via ROV or a hydraulic control line extending from another subsea component), mechanically, or electrically (via hardwired connection or wireless communication).

Jumper adapter 280 of tubular wellhead assembly 250 is generally configured to provide a releasable connection between the wellhead connector 252 and wellhead jumper 150, where jumper adapter 280 couples with or comprises the terminal end 152 of wellhead jumper 150. In the embodiment shown in FIG. 4, the upper end 252A of wellhead connector 252 is received within an aperture 284 that extends into a lower end of jumper adapter 280. A releasable connection 284 is formed between jumper adapter 280 and the upper end 252A of wellhead connector 252, thereby establishing fluid communication between the connector passage 176 of connector 252 and jumper passage 154 of wellhead jumper 150. In this embodiment, releasable connection 284 comprises a releasable clamp connection; however, in other embodiments, connection 284 may comprise other releasable connections known in the art. In some embodiments, releasable connection 284 comprises a connection that may be connected or disconnected subsea, such as with the assistance of a ROV.

Figure 5:
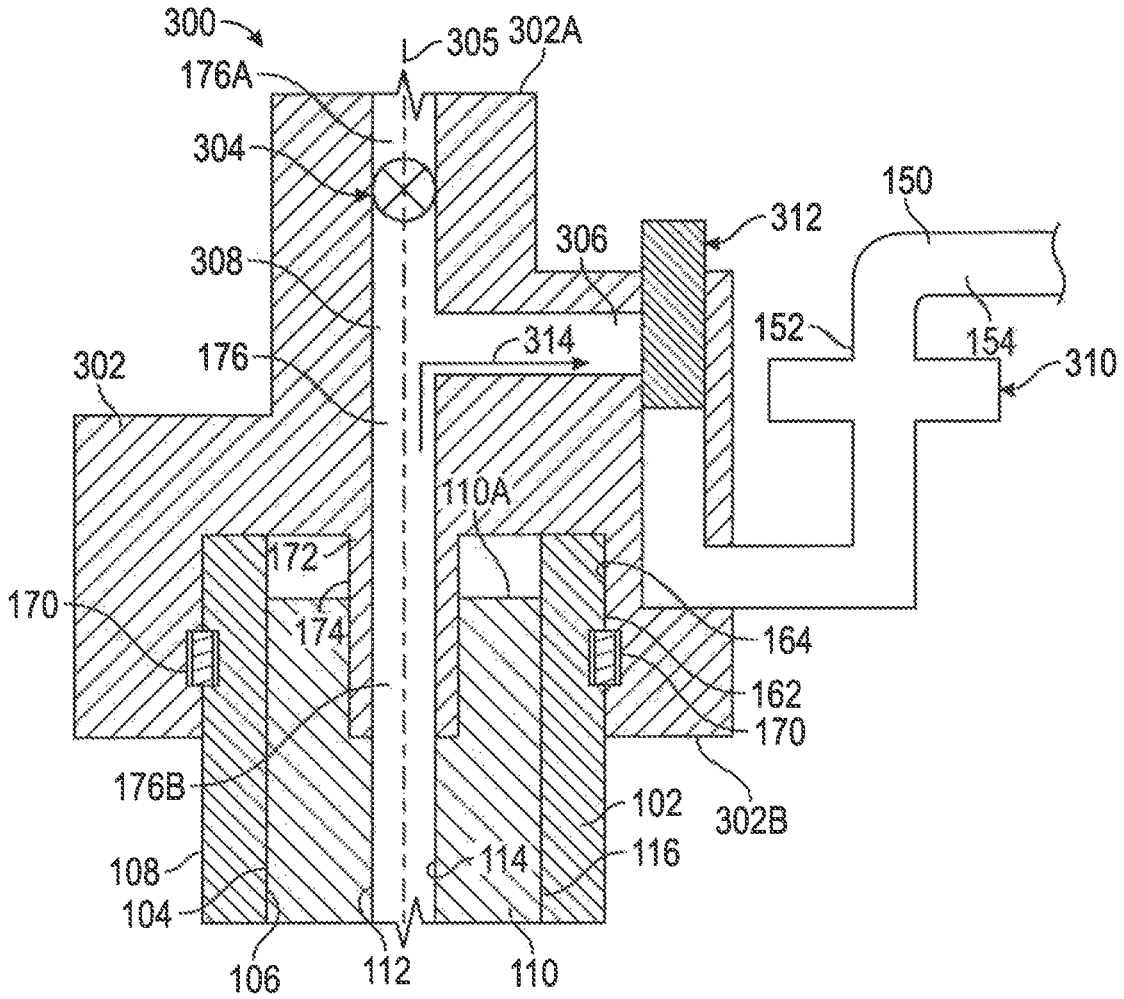
FIG. 5 depicts a wellhead assembly of the well system of FIG. 1 in accordance with one or more embodiments of the present disclosure.

Referring to FIG. 5, another embodiment of a tubular wellhead assembly 300 of the present disclosure is shown schematically. Tubular wellhead assembly 300 includes features in common with the tubular wellhead assembly 100 shown in FIG. 1, and shared features are labeled similarly. Tubular wellhead assembly 300 may be incorporated within well system 10 shown in FIG. 1, as well as in other well systems. In the embodiment shown in FIG. 5, tubular wellhead assembly 300 has a central or longitudinal axis 305 and generally includes wellhead housing 102, tubing hanger 110, a wellhead connector 302, and a tubular string (not shown). Wellhead connector 302 of tubular wellhead assembly 300 includes a first or upper end 302A, a second or lower end 302B, and a connector valve or selective barrier element 304 disposed in connector passage 176. Connector valve 304 selectively restricts fluid communication between a first or upper end 176A of passage 176 and a second or lower end 176B of passage 176 and may be configured similarly (i.e., comprise a similar style valve) as connector valves 254 of the wellhead connector 252 shown in FIG. 4.

Additionally, wellhead connector 302 includes a branch production passage or conduit 306 extending between a junction or connection 308 formed in connector passage 176 and a wellhead jumper connection or spool 310 extending from wellhead connector 302, where junction 308 is disposed between the upper 176A and lower 176B ends of connector passage 176. Jumper connection 310 provides a releasable connection, such as a clamp or collet connection, between wellhead connector 302 and wellhead jumper 150, and is thereby configured to establish fluid communication between wellhead jumper 150 and branch passage 306. Further, wellhead connector 302 includes a retrievable connector choke or flow control device 312 retractably disposed in branch passage 306. Connector choke 312 is configured to selectively change or control the rate of fluid flow through branch passage 306 towards wellhead jumper 150. In some embodiments, connector choke 312 comprises a choke similar in style to those used in production trees known in the art; however, in other embodiments, connector choke 312 may be configured similarly as choke 127 discussed above.

In the configuration shown in FIG. 5, connector valve 304, branch passage 306, and choke 312 are configured to allow for the flow of produced well fluids from tubing string 120 into wellhead jumper 150, and the insertion of fluids or components, such as coiled tubing or other well intervention devices, into tubing string 120 via connector passage 176. Particularly, with connector valve 304 disposed in a closed position and choke 312 disposed in at least a partially open position, a production fluid passage 314 may be established that extends from production passage 122 of tubing string 120, through branch passage 306 via connector passage 176 and junction 308, and into jumper passage 154 via jumper connection 310. Conversely, with connector valve 304 disposed in an open position, a tool or intervention device (not shown), such as a pigging device, may be inserted into production passage 122 of tubing string 120 via connector passage 176 of wellhead connector 302. Additionally, with choke 312 disposed in a closed position and connector valve 304 disposed in an open position, fluids may be injected into production passage 122 of tubing string 120 via connector passage 176, where the injected fluids are controlled or restricted from flowing into wellhead jumper 150 via the closed choke 312. In this embodiment, a jumper or running tool may be coupled to the upper end 302A of wellhead connector 302 to facilitate the transfer of tools or fluids into connector passage 176 of wellhead connector 302. Although in the embodiment shown in FIG. 5 the connector passage 176 extends beyond junction 308 to upper end 176A, in other embodiments, connector passage 176 may terminate at junction 308, thereby eliminating connector valve 304 and the insertion/injection functionality described above.

Figure 6:
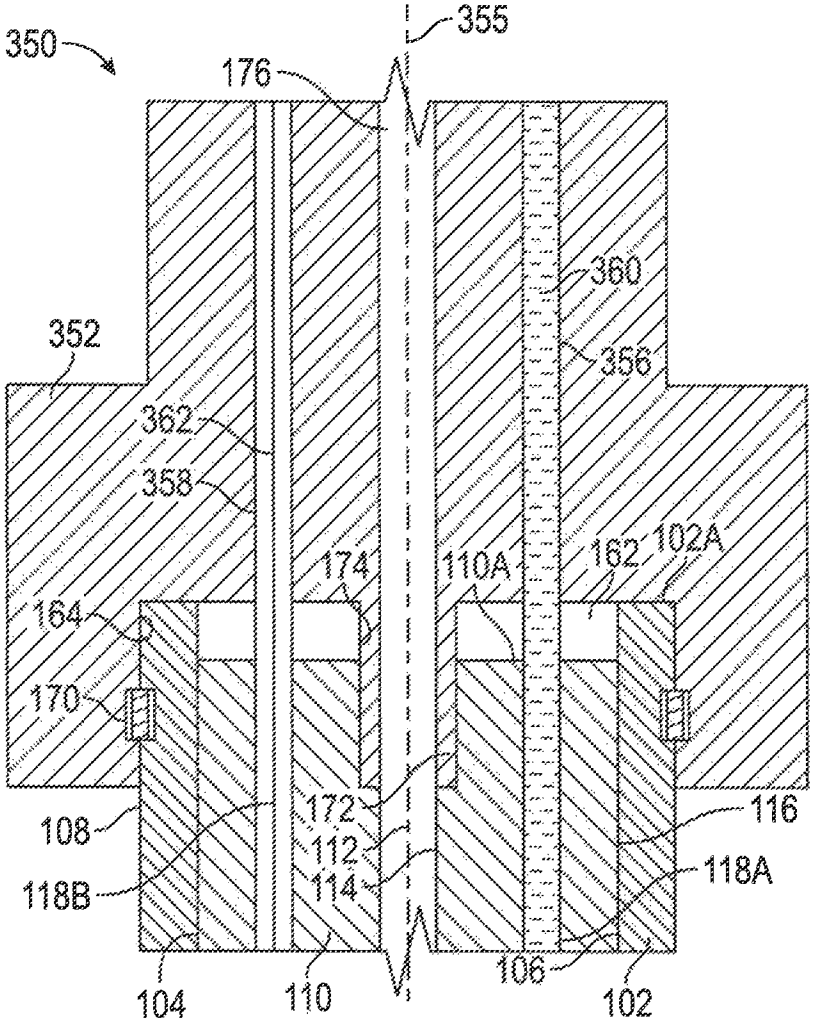
FIG. 6 depicts a wellhead assembly of the well system of FIG. 1 in accordance with one or more embodiments of the present disclosure.

Referring to FIG. 6, another embodiment of a tubular wellhead assembly 350 of the present disclosure is shown schematically. Tubular wellhead assembly 350 includes features in common with the tubular wellhead assembly 100 shown in FIG. 1, and shared features are labeled similarly. Tubular wellhead assembly 350 may be incorporated within well system 10 shown in FIG. 1, as well as in other well systems. In the embodiment shown in FIG. 6, tubular wellhead assembly 350 has a central or longitudinal axis 355 and generally includes wellhead housing 102, tubing hanger 110, a wellhead connector 352, and a tubular string (not shown). In the embodiment shown in FIG. 6, wellhead connector 352 includes a radially offset and axially extending (i.e., extending parallel central axis 355) annulus bore or passage 356 and communications passage 358. Annulus passage 356 of connector 352 is configured to receive an annulus flowline or conduit 360 therein for establishing fluid communication with annulus 107 (not shown in FIG. 6) via annulus passage 118A of tubing hanger 110. Although in the embodiment shown in FIG. 7 annulus passage 356 includes annulus conduit 360 extending therein, in other embodiments, passage 356 may not include annulus conduit 360, and instead, a sealed fluid connection may be provided between annulus passage 356 of wellhead connector 352 and control line passage 118B of tubing hanger 110.

Communications passage 358 of connector 352 is configured to receive a control line or communications conduit 362 therein that extends into annulus 107 via control line passage 118B of tubing hanger 110, where control line conduit 362 comprises the individual control lines (e.g., control lines 192, 194, and 196, etc.) responsible for actuating the various components (e.g., components 123, 125, and 127, etc.) disposed within wellhead housing 102 and its associated wellbore, as well as signal pathways or conduits in communication with sensors or other measurement devices disposed within either wellhead housing 102 or the corresponding wellbore. In the embodiment shown in FIG. 6, annulus conduit 360 and control line conduit 362 are each packaged within wellhead jumper 150 such that jumper 150 comprises not only jumper passage 154 for the passage of production fluids from the production passage 122 of tubing string 120, but also annulus passage 356 and communications passage 358 for the passage of fluids from annulus 107 and the extension of controls or communications with components of tubular wellhead assembly 350. In this manner, by coupling wellhead connector 352 with wellhead housing 102, production fluids, annulus fluids, and control/communication signals may be communicated between wellhead jumper 150 and tubular wellhead assembly 350.

Figure 7:
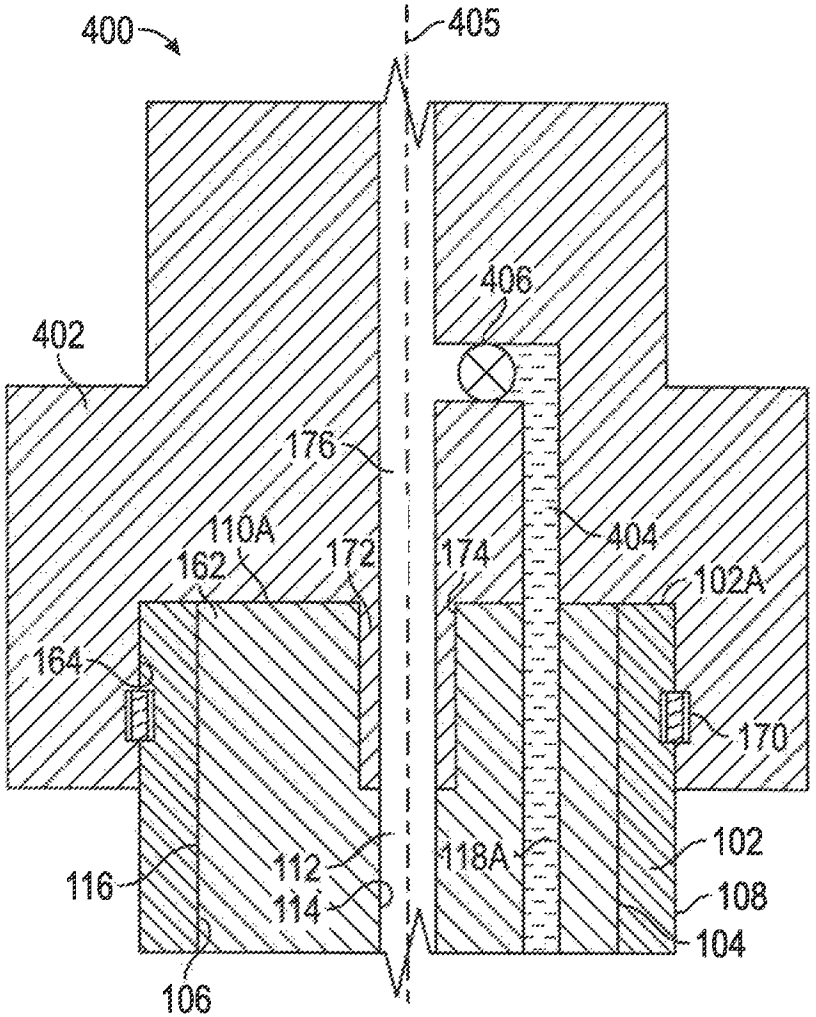
FIG. 7 depicts a wellhead assembly of the well system of FIG. 1 in accordance with one or more embodiments of the present disclosure.

Referring to FIG. 7, another embodiment of a tubular wellhead assembly 400 of the present disclosure is shown schematically. Tubular wellhead assembly 400 includes features in common with the tubular wellhead assembly 100 shown in FIG. 1 and tubular wellhead assembly 350 shown in FIG. 6, and shared features are labeled similarly. Tubular wellhead assembly 400 may be incorporated within well system 10 shown in FIG. 1, as well as in other well systems. In the embodiment shown in FIG. 7, tubular wellhead assembly 400 has a central or longitudinal axis 405 and generally includes wellhead housing 102, tubing hanger 110, a wellhead connector 402, and a tubular string (not shown). Wellhead connector 402 includes a crossover or annulus passage 404 extending between connector passage 176 and the inner terminal end 165 of the receptacle 162 of wellhead connector 402. Crossover passage 404 includes a crossover valve or selective barrier element 406 disposed therein for selectively restricting fluid communication between annulus 107 and connector passage 176. In some embodiments, crossover valve 406 may be configured similarly as connector valves 254 of the wellhead connector 252 shown in FIG. 4.

When wellhead connector 402 is coupled with wellhead housing 102, fluid communication is established between annulus passage 118A of tubing hanger 110 and crossover passage 404 of wellhead connector 402. With crossover valve 406 disposed in an open position, fluid communication is provided between connector passage 176 of wellhead connector 402 and annulus 107 (not shown in FIG. 7) via crossover passage 404 and annulus passage 118A. In this arrangement, one or both of valves 123 and 125 of tubing string 120 may be closed to allow for fluid disposed in annulus 107 (or the portion of wellbore 60 surrounding tubing string 120) to flow into jumper passage 154 of wellhead jumper 150 via crossover passage 404 of wellhead connector 402. Alternatively, fluids may be injected into annulus 107 via connector passage 176 and crossover passage 404.

Figure 8:
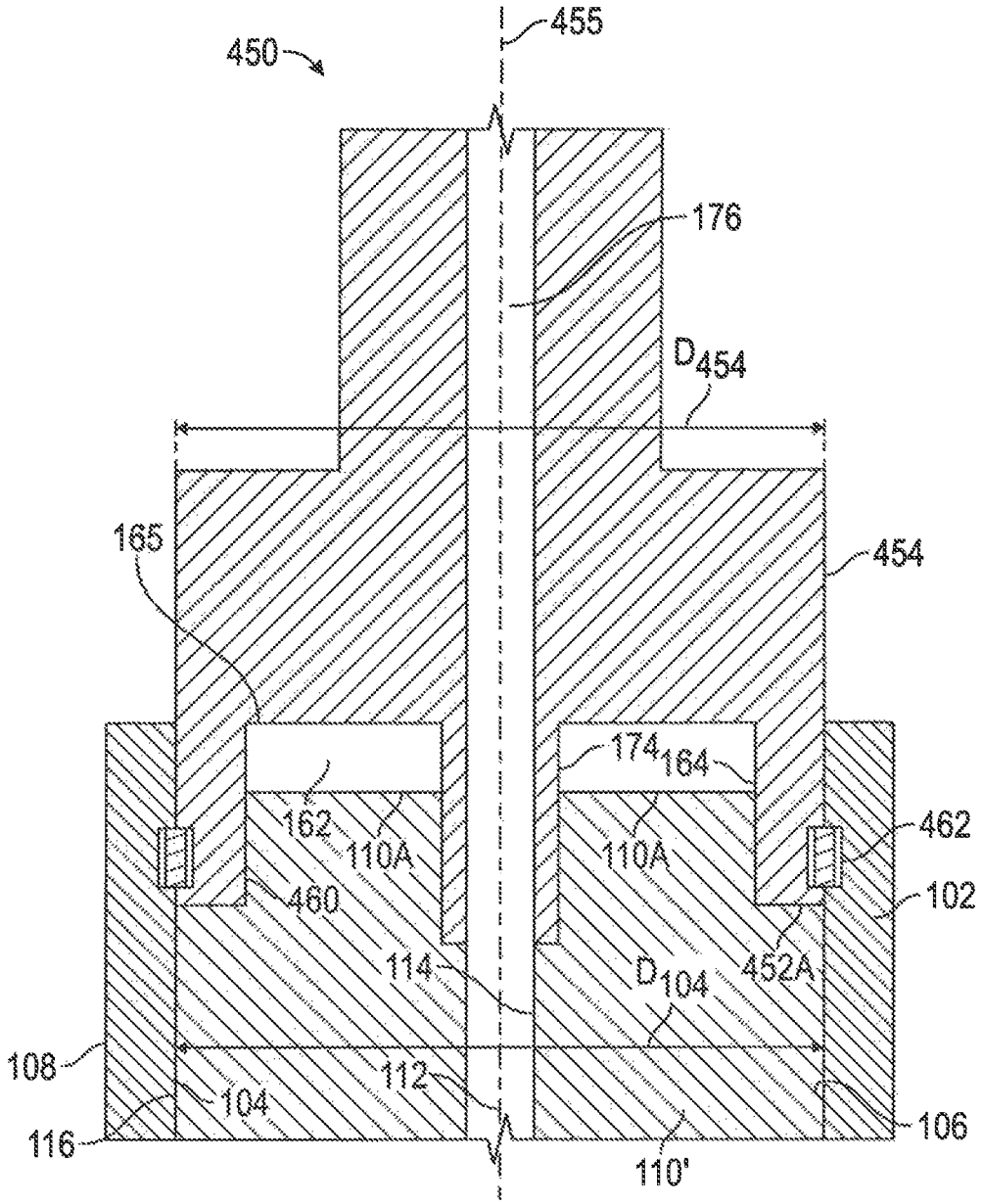
FIG. 8 depicts a wellhead assembly of the well system of FIG. 1 in accordance with one or more embodiments of the present disclosure.

Referring to FIG. 8, another embodiment of a tubular wellhead assembly 450 of the present disclosure is shown schematically. Tubular wellhead assembly 450 includes features in common with the tubular wellhead assembly 100 shown in FIG. 1, and shared features are labeled similarly. Tubular wellhead assembly 450 may be incorporated within well system 10 shown in FIG. 1, as well as in other well systems. In the embodiment shown in FIG. 8, tubular wellhead assembly 450 has a central or longitudinal axis 455 and generally includes wellhead housing 102, a tubing hanger 110', and a wellhead connector 452. Wellhead connector 452 includes a lower end 452A and a generally cylindrical outer surface 454 extending axially therefrom.

In the embodiment shown in FIG. 8, the outer surface 454 of wellhead connector 452 has an outer diameter $D_{454}$ that is less than an inner diameter $D_{104}$ of the passage 104 of wellhead housing 102, allowing the entire outer diameter $D_{454}$ of connector 452 to pass through the inner diameter $D_{104}$ of passage 10 and thereby to be inserted into bore 104 of housing 102. Additionally, in this embodiment, the outer surface 116 of tubing hanger 110' includes an annular groove 460 extending therein at upper end 110A, where flange 456 of connector 452 is received therein. Tubular wellhead assembly 450 includes an actuatable wellhead locking member 462 disposed radially between the outer surface 454 of wellhead connector 452 and the inner surface 106 of wellhead housing 102. In the embodiment shown in FIG. 8, locking member 462 includes an annular lock ring 462 hydraulically actuatable between an unlocked position permitting relative axial movement and detachment between wellhead connector 452 and wellhead housing 102, and a locked position restricting relative axial movement therebetween and wellhead connector 452 and housing 102; however, in other embodiments, wellhead locking member 462 may comprise various locking mechanisms known in the art. Thus, unlike locking member 170 of tubular wellhead assembly 100 which engages the outer surface 108 of wellhead housing 102, wellhead locking member 462 of tubular wellhead assembly 450 couples connector 452 to wellhead housing 102 via engaging the inner surface 106 of housing 102.

The ability to position wellhead connector 452 within wellhead housing 102 of tubular wellhead system 450 allows for additional equipment, such as intervention devices or a jumper adapter, etc., to be directly coupled to the outer surface 108 of wellhead housing 102 instead of with wellhead connector 452 while connector 452 provides a flowpath between the production passage 122 of tubing string 120 and/or annulus 107 and corresponding fluid conduits of the additional equipment mounted to wellhead housing 102. Thus, loads may be directly transmitted between the additional equipment and wellhead housing 102 instead of through wellhead connector 452. Additionally, by allowing additional equipment to directly interface with wellhead housing 102, the overall costs of providing and interfacing with tubular wellhead assembly 450 may be reduced and the architecture of assembly 450 may be simplified over traditional wellhead assemblies.

An embodiment of a wellhead assembly of a well system for installation in a wellbore, the wellhead assembly having a longitudinal axis and comprising a wellhead housing comprising a central passage defined by an inner surface, a tubular string configured to be received in the passage of the wellhead housing, wherein the tubular string comprises a passage, a first valve coupled to the tubular string and comprising an open position and a closed position configured to seal fluid flow through the passage of the tubular string in both a first direction and a second direction opposite the first direction, a second valve coupled to the tubular string and axially spaced from the first valve, wherein the second valve comprises an open position and a closed position configured to seal fluid flow through the passage of the tubular string in both a first direction and a second direction opposite the first direction, and a wellhead connector configured to releasably couple to an end of the wellhead housing and comprising a first passage in fluid communication with the passage of the tubular string when the wellhead connector is coupled to the wellhead housing. In some embodiments, the wellhead assembly further comprises a hanger configured to be received within the passage of the wellhead housing and couple to the inner surface of the housing, wherein the tubular string extends from the hanger. In some embodiments, the first valve is disposed proximal to the hanger. In certain embodiments, the hanger comprises a tubing hanger and the tubular string comprises a tubing string configured to convey well fluids from the wellbore to the first passage of the wellhead connector. In certain embodiments, the first valve is remotely actuatable via a control signal communicated to the first valve, and the second valve is remotely actuatable via a control signal communicated to the second valve. In some embodiments, the wellhead connector comprises an annulus passage in fluid communication with an annulus formed between the tubular string and the wellhead housing when the wellhead connector is coupled to the wellhead housing. In some embodiments, the wellhead assembly further comprises a communications link coupled to the wellhead connector, wherein the communications link is configured to transmit a control signal to the first valve to actuate the first valve between the open and closed positions. In some embodiments, the wellhead connector comprises a communications passage, and the communications link comprises a hydraulic control line extending through the communications passage of the wellhead connector to the first valve when the wellhead connector is coupled to the wellhead housing. In certain embodiments, the wellhead connector is configured to releasably couple with the wellhead housing to provide fluid communication between a passage of the hanger and the first passage of the wellhead connector. In certain embodiments, the wellhead assembly further comprises a locking member disposed radially between the wellhead connector and the wellhead housing to releasably couple the wellhead connector with the wellhead housing.

An embodiment of a wellhead assembly of a well system for installation in a wellbore, the wellhead assembly having a longitudinal axis and comprising a wellhead housing comprising a central passage defined by an inner surface, a hanger configured to be received within the passage of the wellhead housing and couple to the inner surface of the housing, a tubular string configured to be received in the passage of the wellhead housing, wherein the tubular string comprises a passage, a choke coupled to the tubular string and configured to control a fluid flow through the passage of the tubular string, and a wellhead connector configured to releasably couple to an end of the wellhead housing and comprising a first passage in fluid communication with passage of the tubular string when the wellhead connector is coupled to the wellhead housing. In some embodiments, the wellhead assembly further comprises a communications link coupled to the wellhead connector, wherein the communications link is configured to control the actuation of the choke. In some embodiments, the wellhead assembly further comprises a first sensor coupled to the tubular string and configured to measure a parameter of fluid disposed in the passage of the tubular string, and a second sensor coupled to the tubular string and configured to measure a parameter of fluid disposed in an annulus formed around the tubular string when the tubular string is received in the wellhead housing. In certain embodiments, the wellhead connector comprises a communications passage, and the communications link comprises a cable extending through the communications passage of the wellhead connector to the first and second sensors, wherein the cable is configured to transmit sensor data from the first and second sensors. In certain embodiments, the choke is coupled between a pair of pipe joints of the tubular string. In some embodiments, the wellhead assembly further comprises a connector valve disposed in the first passage of the wellhead connector and configured to selectively restrict fluid flow through the first passage of the wellhead connector. In some embodiments, the wellhead connector further comprises a branch passage extending between the first passage and a jumper connection configured to connect the branch passage to a wellhead jumper. In certain embodiments, the wellhead assembly further comprises a choke disposed in the branch passage and configured to control fluid flow through the branch passage, and a connector valve disposed in the first passage of the wellhead connector and configured to selectively restrict fluid flow through the first passage.

An embodiment of a wellhead assembly of a well system for installation in a wellbore, the wellhead assembly having a longitudinal axis and comprising a wellhead housing comprising a central passage defined by an inner surface, a hanger configured to be received within the passage of the wellhead housing and couple to the inner surface of the housing, a tubular string configured to be received in the passage of the wellhead housing, wherein the tubular string comprises a passage, and a wellhead jumper configured to provide fluid communication between the wellhead assembly and other components of the well system, wherein a terminal end of the wellhead jumper is coupled to a wellhead connector configured to releasably couple to the wellhead housing, wherein the wellhead connector comprises a first passage extending along the longitudinal axis of the wellhead assembly between a first end and a second end, and wherein the first passage is in fluid communication with a passage of the wellhead jumper. In some embodiments, the wellhead connector further comprises a crossover passage extending between the first passage of the wellhead connector and an annulus disposed between the tubular string and the wellhead housing when the wellhead connector is coupled to the wellhead housing, and a crossover valve disposed in the crossover passage and configured to selectively restrict fluid communication between the first passage of the wellhead connector and the annulus when the wellhead connector is coupled to the wellhead housing. In some embodiments, the wellhead assembly further comprises an actuatable locking member disposed radially between an outer surface of the of the wellhead connector and the inner surface of the wellhead housing, wherein the locking member comprises a first position allowing for relative axial movement between the wellhead connector and the wellhead housing, and a second position restricting relative axial movement between the wellhead connector and the wellhead housing. In certain embodiments, the wellhead connector further comprises an annulus passage that receives an annulus conduit in fluid communication with an annulus surrounding the tubular string when the wellhead connector is coupled to the wellhead housing, and a communications passage that receives a control line configured to control the actuation of a valve coupled to the tubular string, wherein the annulus conduit and the control line each extend through the wellhead jumper.

Reference throughout this specification to "one embodiment," "an embodiment," "an embodiment," "embodiments," "some embodiments," "certain embodiments," or similar language means that a particular feature, structure, or characteristic described in connection with the embodiment may be included in at least one embodiment of the present disclosure. Thus, these phrases or similar language throughout this specification may, but do not necessarily, all refer to the same embodiment.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ," it is intended that such elements are to be interpreted under 35 U.S.C. 112(f). However, for any claims containing elements designated in any other manner, it is intended that such elements are not to be interpreted under 35 U.S.C. 112(f).

The above discussion is meant to be illustrative of the principles and various embodiments of the present disclosure. While certain embodiments have been shown and described, modifications thereof can be made by one skilled in the art without departing from the spirit and teachings of the disclosure. The embodiments described herein are exemplary only, and are not limiting. Accordingly, the scope of protection is not limited by the description set out above, but is only limited by the claims which follow, that scope including all equivalents of the subject matter of the claims.

What is claimed is:

1. A wellhead assembly of a well system for installation in a wellbore, the wellhead assembly having a longitudinal axis and comprising:

a wellhead housing comprising an outer surface and a central passage defined by an inner surface;

a tubular string configured to be received in the passage of the wellhead housing, wherein the tubular string comprises a passage;

a hanger comprising a central passage, the hanger configured to be received within the passage of the wellhead housing and couple to the inner surface of the housing, wherein the tubular string extends from the hanger;

a choke coupled to the tubular string below the hanger and configured to control a fluid flow through the passage of the tubular string, and wherein the choke is selectively adjustable between a fully open position and a partially closed position;

a first valve coupled to the tubular string below the hanger and comprising an open position and a closed position configured to seal fluid flow through the passage of the tubular string in both a first direction and a second direction opposite the first direction;

a second valve coupled to the tubular string below the hanger and axially spaced from the first valve, wherein the second valve comprises an open position and a closed position configured to seal fluid flow through the passage of the tubular string in both a first direction and a second direction opposite the first direction;

a third valve coupled to the tubular string below the hanger and axially spaced from the first valve and the second valve, wherein the third valve is configured to actuate between an open position and a closed position configured to seal fluid flow through the passage of the tubular string;

a wellhead connector configured to releasably couple to the outer surface of the wellhead housing and stab into the central passage of the hanger, wherein the wellhead connector comprises a first passage in fluid communication with the passage of the tubular string when the wellhead connector is coupled to the wellhead housing; and wherein the first valve and the choke are each positioned within the central passage of the wellhead housing.

2. The wellhead assembly of claim 1, wherein the first valve is disposed proximal to the hanger.

3. The wellhead assembly of claim 1, wherein the hanger comprises a tubing hanger and the tubular string comprises a tubing string configured to convey well fluids from the wellbore to the first passage of the wellhead connector.

4. The wellhead assembly of claim 1, wherein:

the first valve is remotely actuatable via a control signal communicated to the first valve; and the second valve is remotely actuatable via a control signal communicated to the second valve.

5. The wellhead assembly of claim 1, wherein the wellhead connector comprises an annulus passage in fluid communication with an annulus formed between the tubular string and the wellhead housing when the wellhead connector is coupled to the wellhead housing.

6. The wellhead assembly of claim 1, further comprising a communications link coupled to the wellhead connector, wherein the communications link is configured to transmit a control signal to the first valve to actuate the first valve between the open and closed positions.

7. The wellhead assembly of claim 6, wherein:

the wellhead connector comprises a communications passage; and the communications link comprises a hydraulic control line extending through the communications passage of the wellhead connector to the first valve when the wellhead connector is coupled to the wellhead housing.

8. The wellhead assembly of claim 1, wherein the wellhead connector is configured to releasably couple with the wellhead housing to provide fluid communication between a passage of the hanger and the first passage of the wellhead connector.

9. The wellhead assembly of claim 8, further comprising a locking member disposed radially between the wellhead connector and the wellhead housing to releasably couple the wellhead connector with the wellhead housing.

10. A wellhead assembly of a well system for installation in a wellbore, the wellhead assembly having a longitudinal axis and comprising:

a wellhead housing comprising an outer surface and a central passage defined by an inner surface;

a hanger comprising a central passage, the hanger configured to be received within the passage of the wellhead housing and couple to the inner surface of the housing;

a tubular string configured to be received in the passage of the wellhead housing and extend from the hanger, wherein the tubular string comprises a passage;

a first choke coupled to the tubular string below the hanger and configured to control a fluid flow through the passage of the tubular string, wherein the first choke is selectively adjustable between a fully open position and a partially closed position; and a wellhead connector configured to releasably couple to the outer surface of the wellhead housing and stab into the central passage of the hanger, wherein the wellhead connector comprises a first passage in fluid communication with the passage of the tubular string when the wellhead connector is coupled to the wellhead housing, and a hydraulic control line extending through the wellhead connector and configured to transmit a control signal to the first choke; and further comprising a first valve coupled to the tubular string below the hanger and comprising an open position and a closed position configured to seal fluid flow through the passage of the tubular string in both a first direction and a second direction opposite the first direction, wherein the first valve and the first choke are each positioned within the central passage of the wellhead housing.

11. The wellhead assembly of claim 10, further comprising a communications link coupled to the wellhead connector, wherein the communications link is configured to control the actuation of the first choke.

12. The wellhead assembly of claim 11, further comprising:

a first sensor coupled to the tubular string and configured to measure a parameter of fluid disposed in the passage of the tubular string; and a second sensor coupled to the tubular string and configured to measure a parameter of fluid disposed in an annulus formed around the tubular string when the tubular string is received in the wellhead housing.

13. The wellhead assembly of claim 12, wherein:

the wellhead connector comprises a communications passage; and the communications link comprises a cable extending through the communications passage of the wellhead connector to the first and second sensors, wherein the cable is configured to transmit sensor data from the first and second sensors.

14. The wellhead assembly of claim 10, wherein the first choke is coupled between a pair of pipe joints of the tubular string.

15. The wellhead assembly of claim 10, further comprising a connector valve disposed in the first passage of the wellhead connector and configured to selectively restrict fluid flow through the first passage of the wellhead connector.

16. The wellhead assembly of claim 10, wherein the wellhead connector further comprises a branch passage extending between the first passage and a jumper connection configured to connect the branch passage to a wellhead jumper.

17. The wellhead assembly of claim 16, further comprising:

a second choke disposed in the branch passage and configured to control fluid flow through the branch passage; and a connector valve disposed in the first passage of the wellhead connector and configured to selectively restrict fluid flow through the first passage.

18. A wellhead assembly of a well system for installation in a wellbore, the wellhead assembly having a longitudinal axis and comprising:

a wellhead housing comprising a central passage defined by an inner surface;

a hanger configured to be received within the passage of the wellhead housing and couple to the inner surface of the housing;

a tubular string configured to be received in the passage of the wellhead housing and extend from the hanger, wherein the tubular string comprises a passage;

a choke coupled to the tubular string below the hanger and configured to control a fluid flow through the passage of the tubular string, wherein the choke is selectively adjustable between a fully open position and a partially closed position;

a wellhead jumper configured to provide fluid communication between the wellhead assembly and other components of the well system, wherein a terminal end of the wellhead jumper is coupled to a wellhead connector;

wherein the wellhead connector is configured to releasably couple to an outer surface of the wellhead housing and stab into a central passage of the hanger;

wherein the wellhead connector comprises a hydraulic control line extending through the wellhead connector and configured to transmit a control signal to the choke;

wherein the wellhead connector further comprises a first passage extending along the longitudinal axis of the wellhead assembly between a first end and a second end, and wherein the first passage is in fluid communication with a passage of the wellhead jumper; and further comprising a first valve coupled to the tubular string below the hanger and comprising an open position and a closed position configured to seal fluid flow through the passage of the tubular string in both a first direction and a second direction opposite the first direction, wherein the first valve and the first choke are each positioned within the central passage of the wellhead housing.

19. The wellhead assembly of claim 18, wherein the wellhead connector further comprises:

a crossover passage extending between the first passage of the wellhead connector and an annulus disposed between the tubular string and the wellhead housing when the wellhead connector is coupled to the wellhead housing; and a crossover valve disposed in the crossover passage and configured to selectively restrict fluid communication between the first passage of the wellhead connector and the annulus when the wellhead connector is coupled to the wellhead housing.

20. The wellhead assembly of claim 18, wherein the wellhead assembly further comprises:

an actuatable locking member disposed radially between an inner surface of the wellhead connector and the outer surface of the wellhead housing;

wherein the locking member comprises a first position allowing for relative axial movement between the wellhead connector and the wellhead housing, and a second position restricting relative axial movement between the wellhead connector and the wellhead housing.

21. The wellhead assembly of claim 18, wherein the wellhead connector further comprises:

an annulus passage that receives an annulus conduit in fluid communication with an annulus surrounding the tubular string when the wellhead connector is coupled to the wellhead housing; and a communications passage that receives a control line configured to control the actuation of a valve coupled to the tubular string;

wherein the annulus conduit and the control line each extend through the wellhead jumper.

22. The wellhead assembly of claim 18, wherein the wellhead connector further comprises a body comprising a first end, a second end opposite the first end, a receptacle extending into the body from the second end and defined by an inner surface configured to couple to the outer surface of the wellhead housing, and a hanger connector configured to stab into the central passage of the hanger, and wherein an annular recess is formed between the inner surface and an outer surface of the hanger connector.

* * * * *